US009830858B2

(12) United States Patent
Seo et al.

(10) Patent No.: US 9,830,858 B2
(45) Date of Patent: Nov. 28, 2017

(54) DISPLAY PANEL AND DISPLAY DEVICE HAVING THE SAME

(71) Applicant: LG Display Co., Ltd., Seoul (KR)

(72) Inventors: Woong-Jin Seo, Daegu (KR); Don-Gyou Lee, Seoul (KR); Jun-Woo Jang, Goyang-si (KR); Tae-Yong Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 150 days.

(21) Appl. No.: 14/936,422

(22) Filed: Nov. 9, 2015

(65) Prior Publication Data

US 2017/0004751 A1 Jan. 5, 2017

(30) Foreign Application Priority Data

Jun. 30, 2015 (KR) ..... 10-2015-0092676

(51) Int. Cl.
*G09G 3/20* (2006.01)
*G09G 3/3208* (2016.01)
*G09G 3/3233* (2016.01)

(52) U.S. Cl.
CPC ... *G09G 3/3233* (2013.01); *G09G 2300/0426* (2013.01); *G09G 2300/0452* (2013.01); *G09G 2320/0242* (2013.01); *G09G 2340/0457* (2013.01)

(58) Field of Classification Search
CPC ..... G09G 3/3233; G09G 2300/0426; G09G 2340/0457; G09G 2320/0242; G09G 2300/0452
See application file for complete search history.

(56) References Cited

U.S. PATENT DOCUMENTS 8,884,994 B2 * 11/2014 Brown Elliott ..... G09G 5/02 345/102
2015/0015600 A1 * 1/2015 Yang ..... G09G 3/2003 345/600
2015/0116390 A1 * 4/2015 Roth ..... G09G 3/3607 345/694

* cited by examiner

*Primary Examiner* — Andrew Sasinowski
(74) *Attorney, Agent, or Firm* — Fenwick & West LLP

(57) ABSTRACT

Disclosed herein are a display panel capable of improving high-resolution expression ability and a display device having the same. The display panel includes a plurality of unit pixels, each of which includes first and second sub-pixels alternately arranged in the same vertical line and a third sub-pixel arranged in a different vertical line than the first and second sub-pixels, wherein, when a bright (or dark) image is realized on a dark (or bright) background image, the color of the third sub-pixel is realized at leftmost and rightmost portions of the bright (or dark) image.

9 Claims, 7 Drawing Sheets

DISPLAY PANEL AND DISPLAY DEVICE HAVING THE SAME

CROSS-REFERENCE TO RELATED APPLICATIONS

This application claims the benefit of Korean Patent Application No. 10-2015-0092676, filed on Jun. 30, 2015, which is hereby incorporated by reference as if fully set forth herein.

BACKGROUND

Field of the Invention

The present invention relates to a display panel capable of improving high-resolution expression ability and a display device having the same.

Discussion of the Related Art

Image display devices for displaying various kinds of information on a screen, have been developed such that the image display devices are thinner, lighter, and portable, and exhibit high performance. In addition, flat panel display devices, which have lower weight and volume than cathode ray tubes (CRT), have been highlighted.

A flat panel display device includes a plurality of unit pixels, each of which includes red, green, and blue sub-pixels, for realizing various kinds of color images. The red, green, and blue sub-pixels are arranged in a stripe pattern in which sub-pixels having the same color are arranged in columns.

In a case in which the sub-pixels are arranged in the stripe pattern, however, an aperture ratio is lowered due to a black matrix disposed between the respective sub-pixels with the result that high-resolution expression ability is lowered.

SUMMARY

Accordingly, the present disclosure is directed to a display panel and a display device having the same that substantially obviate one or more problems due to limitations and disadvantages of the related art.

An object of the present disclosure is to provide a display panel capable of improving high-resolution expression ability and a display device having the same.

Additional advantages, objectives, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objectives and other advantages and in accordance with the purpose of the disclosure, as embodied and broadly described herein, a display panel and a display device having the same include a plurality of unit pixels, each of which includes first and second sub-pixels alternately arranged in the same vertical line and a third sub-pixel arranged in a different vertical line than the first and second sub-pixels, wherein, when a bright (or dark) image is realized on a dark (or bright) background image, the color of the third sub-pixel is realized at leftmost and rightmost portions of the bright (or dark) image.

BRIEF DESCRIPTION OF THE DRAWINGS

The accompanying drawings, which are included to provide a further understanding of the disclosure and are incorporated in and constitute a part of this application, illustrate embodiment(s) and together with the description serve to explain the principle of the invention. In the drawings.

DETAILED DESCRIPTION

Reference will now be made in detail to embodiments of the present invention, examples of which are illustrated in the accompanying drawings. Wherever possible, the same reference numbers will be used throughout the drawings to refer to the same or like parts.

Figure 1:
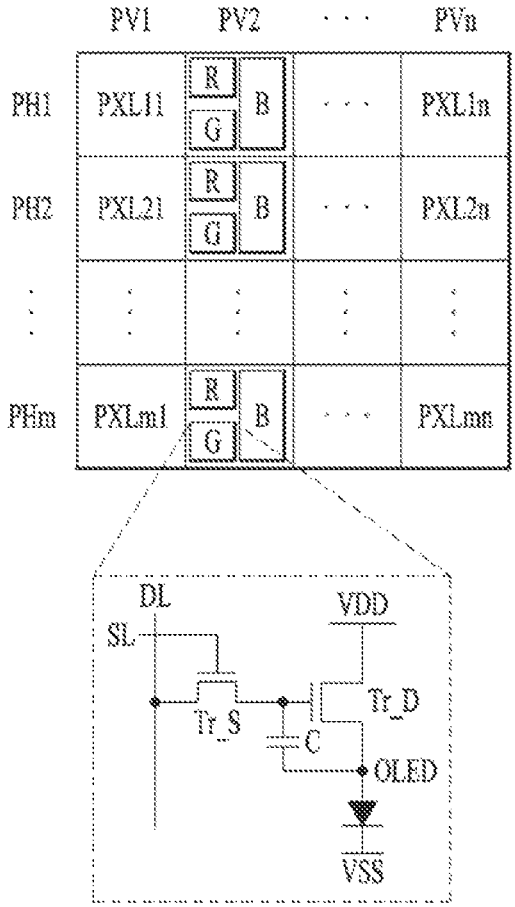
FIG. 1 is a view showing a display panel according to one embodiment.

FIG. 1 is a view showing a display panel according to one embodiment.

The display panel shown in FIG. 1 is embodied by a liquid crystal display panel or an organic light emitting diode panel. An organic light emitting diode panel will be described by way of example.

The display panel shown in FIG. 1 includes unit pixels PXL11 to PXLmn located at intersections of a plurality of pixel rows PH1 to PHm and a plurality of pixel columns PV1 to PVn. Each of the unit pixels PXL11 to PXLmn includes a red (R) sub-pixel, which is a first sub-pixel, a green (G) sub-pixel, which is a second sub-pixel, and a blue (B) sub-pixel, which is a third sub-pixel.

In a case in which the display panel is an organic light emitting diode panel, each of the red (R), green (G), and blue (B) sub-pixels includes a pixel driving circuit and an organic light emitting diode OLED.

The pixel driving circuit supplies data current, corresponding to a data signal supplied to a data line DL, to the organic light emitting diode OLED in response to a scan signal supplied to a scan line SL. To this end, the pixel driving circuit includes a switching transistor Tr_S, a driving transistor Tr_D, and a capacitor C. The switching transistor Tr_S is switched according to the scan signal supplied to the scan line SL to supply the data signal supplied to the data line DL to the driving transistor Tr_D. The driving transistor Tr_D is switched according to the data signal supplied from the switching transistor Tr_S to control current flowing from a high potential voltage source VDD to the organic light emitting diode OLED. The capacitor C is connected between a scan terminal of the driving transistor Tr_D and a low potential voltage source VSS to store voltage corresponding to the data signal supplied to the scan terminal of the driving transistor Tr_D and to keep the driving transistor Tr_D constantly turned on throughout one frame using the stored voltage.

The organic light emitting diode OLED is electrically connected between a source terminal of the driving transistor Tr_D and the low potential voltage source VSS to emit light based on current corresponding to the data signal supplied from the driving transistor Tr_D. The organic light emitting diode OLED includes an anode connected to the source terminal of the driving transistor Tr_D, an organic layer formed on the anode, and a cathode formed on the organic layer. The organic layer may include a hole injection layer/hole transporting layer/light emitting layer/electron transporting layer/electron injection layer.

Consequently, each of the red (R), green (G), and blue (B) sub-pixels controls the magnitude of current flowing from the high potential voltage source VDD to the organic light emitting diode OLED using switching of the driving transistor Tr_D based on the data signal to emit light from the light emitting layer of the organic light emitting diode OLED, thereby expressing a predetermined color.

In one embodiment, the blue (B) sub-pixel, which has the lowest efficiency among the red (R), green (G), and blue (B) sub-pixels, has the largest area.

In each unit pixel, the red (R) and green (G) sub-pixels are arranged in different horizontal lines so as to be alternately arranged in the same vertical line, and the blue (B) sub-pixel is arranged in a different vertical line than the red (R) and green (G) sub-pixels. In a case in which the red (R), green (G), and blue (B) sub-pixels are arranged as described above, the area of a black matrix is reduced, and high resolution is achieved, as compared with a conventional stripe type structure.

Figure 2:
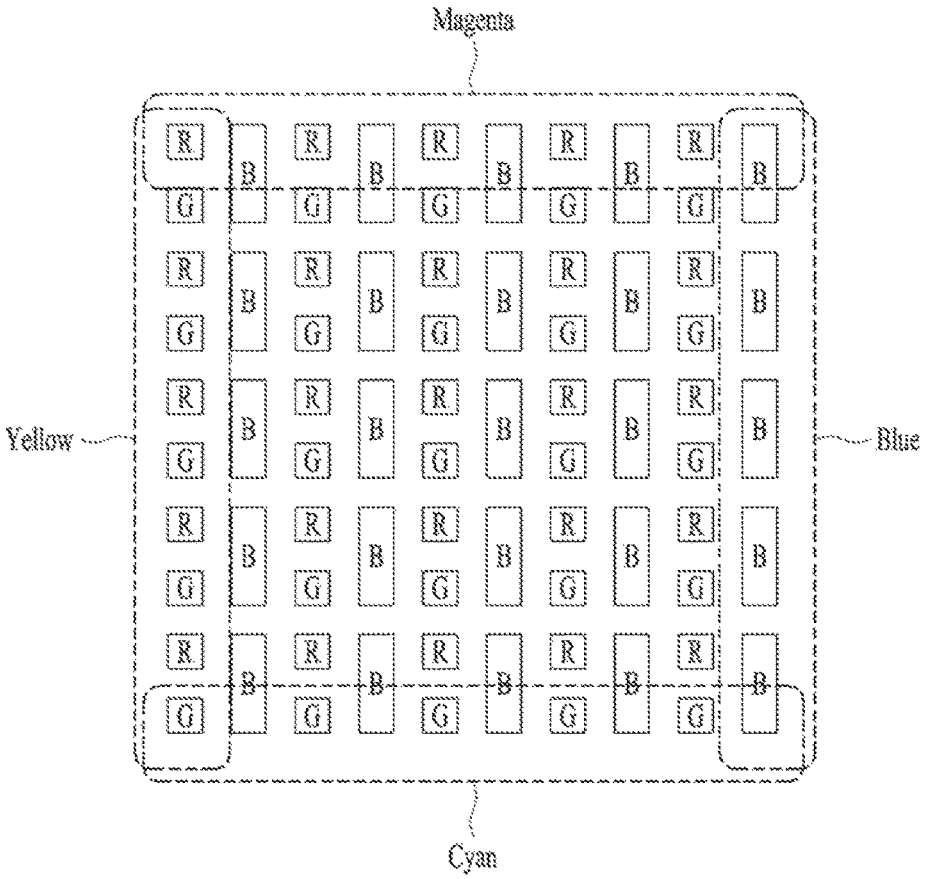
FIG. 2 is a view illustrating a color shift phenomenon occurring in the display panel shown in FIG. 1.

In a case in which a bright image and a dark image are realized on a screen of the display panel, a color shift phenomenon occurs at the boundary between the bright image and the dark image. That is, as shown in FIG. 2, magenta is realized on the upper side of the bright image abutting on the dark image as the result of a combination of the red (R) and blue (B) sub-pixels, whereas cyan is realized on the lower side of the bright image as the result of a combination of the green (G) and blue (B) sub-pixels. Consequently, a color shift phenomenon occurs on the upper side and the lower side of the bright image abutting on the dark image due to the asymmetry of colors, in which different colors are realized. In addition, yellow is realized on the right side of the bright image abutting on the dark image as the result of a combination of the red (R) and green (G) sub-pixels, whereas blue is realized on the right side of the bright image due to the blue (B) sub-pixel. Consequently, a color shift phenomenon occurs on the left side and the right side of the bright image abutting on the dark image due to the asymmetry of colors, in which different colors are realized.

Figure 3A:
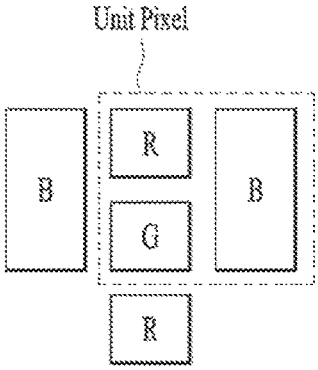
FIGS. 3A to 3C are views illustrating a method of realizing an image using unit pixels of the display panel according to one embodiment.

In order to solve the above problem, as shown in FIG. 3A, red (R) sub-pixels adjacent upward and downward to the green (G) sub-pixel in each unit pixel are driven in cooperation with each other, and blue (B) sub-pixels adjacent left and right of the green (G) sub-pixel in each unit pixel are driven in cooperation with each other. That is, red (R) sub-pixels of unit pixels arranged in a j-th pixel row PHj are driven in cooperation with red (R) sub-pixels of unit pixels arranged in a (j−1)-th pixel row PHj−1. Blue (B) sub-pixels of unit pixels arranged in an i-th pixel column PVi are driven in cooperation with blue (B) sub-pixels of unit pixels arranged in an (i+1)-th pixel column PVi+1.

Figure 3B:
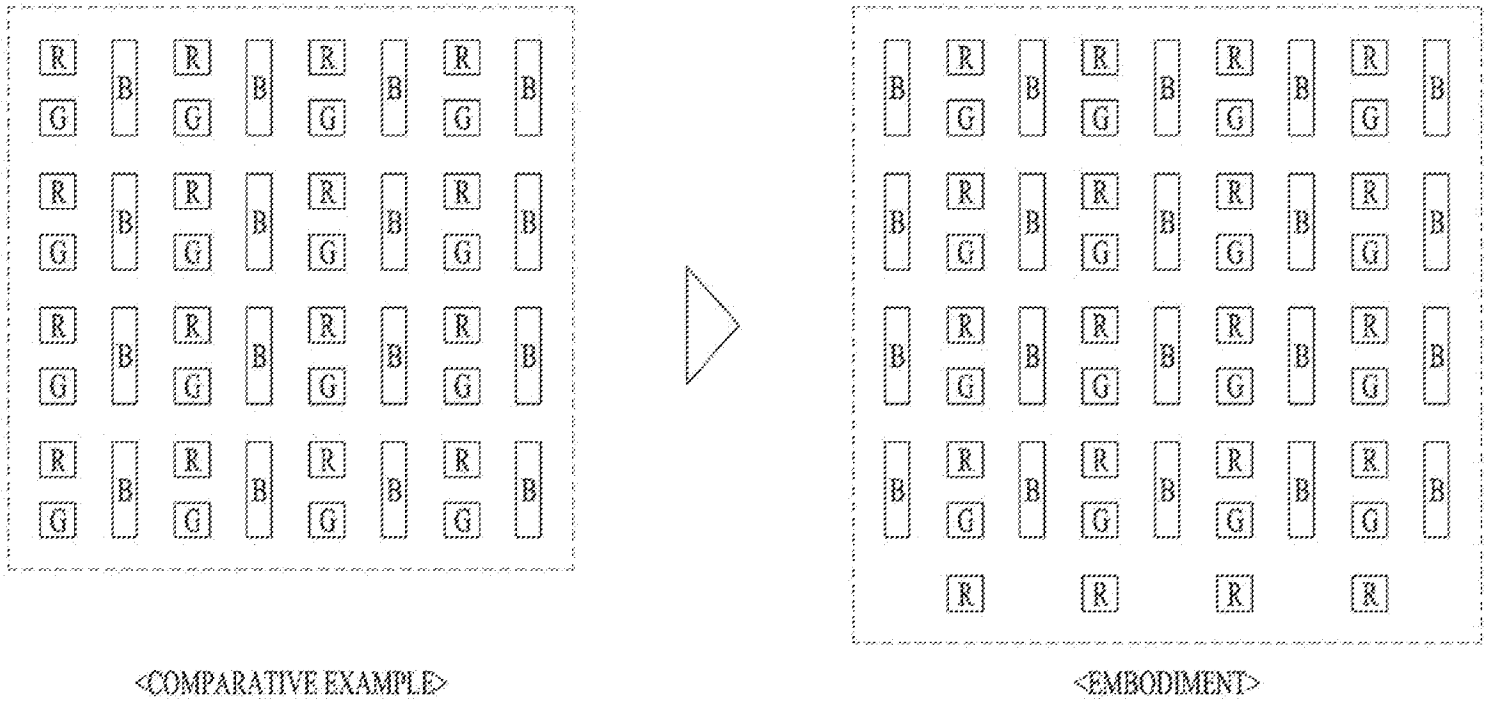
Figure 3C:
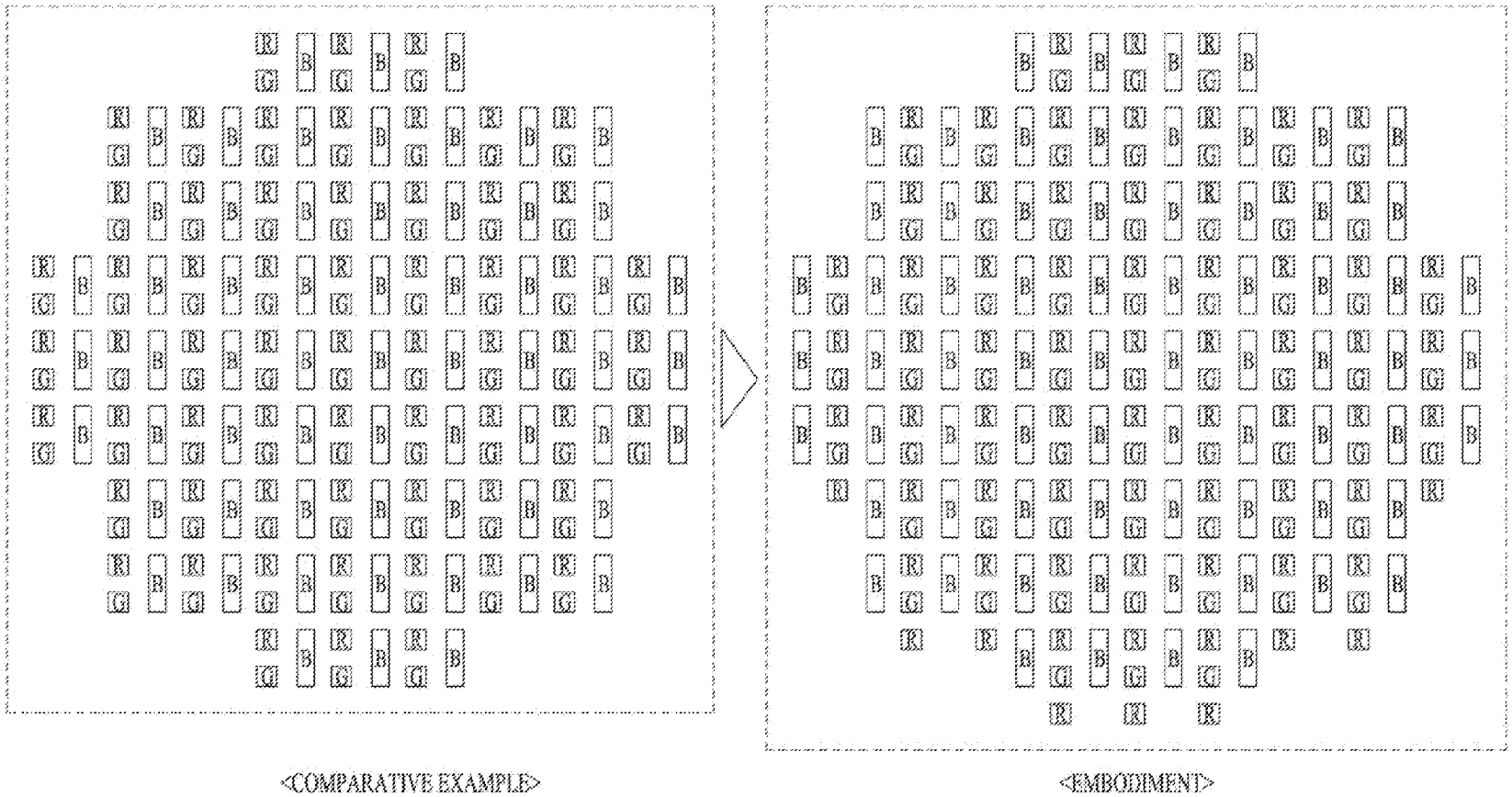

For example, in a case in which a quadrangular image or a circular image is realized on a dark background image as shown in FIGS. 3B and 3C, a comparative example reveals that the uppermost sub-pixels and the lowermost sub-pixels of the quadrangular image or the circular image realize red and green, respectively, whereby vertical asymmetry occurs, and the leftmost sub-pixels and the rightmost sub-pixels of the quadrangular image or the circular image realize yellow and blue, respectively, whereby horizontal asymmetry occurs. As a result, a color shift phenomenon occurs. In contrast, in the present invention, the uppermost sub-pixels and the lowermost sub-pixels of the quadrangular image or the circular image realize red, thereby achieving vertical symmetry of red, and the leftmost sub-pixels and the rightmost sub-pixels of the quadrangular image or the circular image realize blue, thereby achieving horizontal symmetry of blue.

Therefore, horizontal color symmetry and vertical color symmetry are achieved for a bright image displayed on a dark background image, thereby alleviating a color shift phenomenon without reducing sharpness.

In one embodiment, in order to alleviate the color shift phenomenon, input data are rendered through a rendering algorithm, represented by Equation 1 and Equation 2, to generate modulated data R' and B'.

$$R'(i,j)=[\alpha\times(R(i,j)/255)^{gamma}+\beta\times(R(i-1,j)/255)^{gamma}]^{1/gamma}\times 255 \quad \text{[Equation 1]}$$

Equation 1 is applied in a case where red (R) sub-pixels are arranged in a second pixel row PH2≤i≤an m-th (last) pixel row PHm and in a first pixel column PV1≤j≤an n-th (last) pixel column PVn.

Figure 4A:
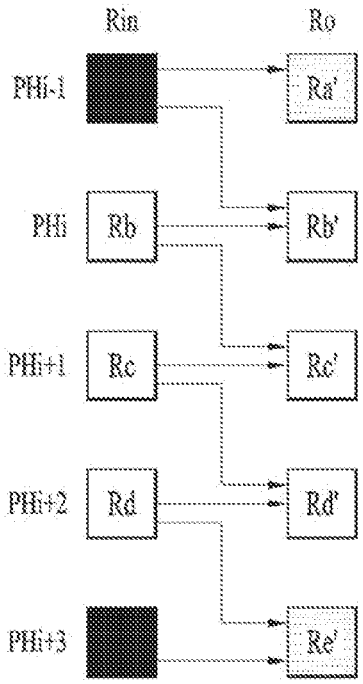
FIGS. 4A and 4B are views illustrating a process of generating modulated red data using red input data according to one embodiment.
Figure 4B:
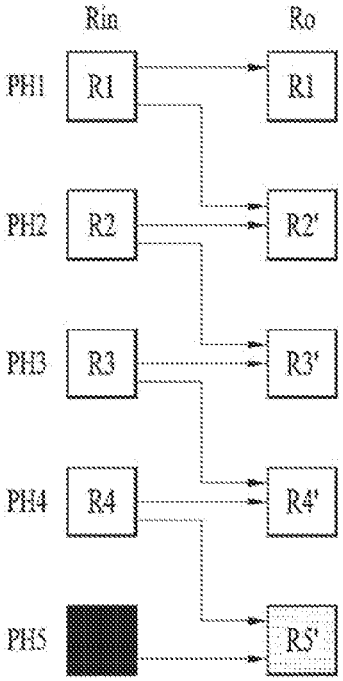

Modulated red data R'(i,j) (Ra', Rb', Rc', and Rd') supplied to red (R) sub-pixels of the current pixel row are generated through red data R(i,j) of the current pixel row and red data R(i−1,j) of the previous pixel row as shown in FIG. 4A. When a bright image is realized on a dark background image, red data of the first pixel row PHi are modulated through black data of the previous pixel row PHi−1, and red data of the last pixel row PHi+3 are modulated through black data of the current pixel row PHi+3. Consequently, the red sub-pixels of the first and last pixel rows PHi and PHi+3 of the bright image have lower brightness than the other red sub-pixels, thereby reducing color shift artifacts. On the other hand, when a bright image is realized on a dark background image, the first pixel row of the bright image is arranged in the first pixel row PH1 as shown in FIG. 4B, input data Ra are maintained.

$$B'(i,j)=[\alpha\times(B(i,j)/255)^{gamma}+\beta\times(B(i,j+1)/255)^{gamma}]^{1/gamma}\times 255 \quad \text{[Equation 2]}$$

Equation 2 is applied in a case where blue (B) sub-pixels are arranged in a first pixel row PH1≤i≤an m-th pixel row PHm and in a first pixel column PV1≤j≤an (n−1)-th pixel column PVn−1.

Modulated blue data B'(i,j) (Ra', Rb', Rc', and Rd') supplied to blue (B) sub-pixels of the current pixel column are generated through blue data B(i,j) of the current pixel column and blue data B(i,j+1) of the next pixel column. When a bright image is realized on a dark background image, the blue sub-pixels of the first and last pixel columns of the bright image have lower brightness than the other blue sub-pixels, thereby reducing color shift artifacts. On the other hand, when a bright image is realized on a dark background image, the last pixel column of the bright image is arranged in the n-th pixel column PVn, input blue data are maintained.

In Equations 1 and 2, α and β are weights, and the sum of α and β is 1.

Figure 5:
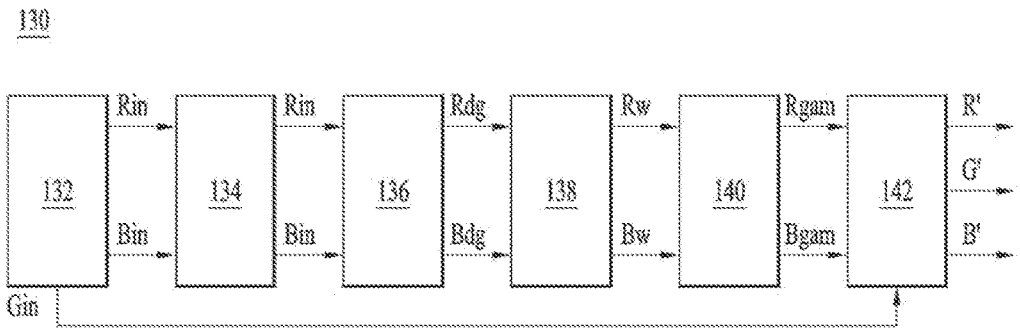
FIG. 5 is a block diagram showing an image processing unit according to one embodiment in detail.

In order to generate modulated data through Equations 1 and 2, the display panel according to different embodiments includes an image processing unit 130 shown in FIG. 5.

The image processing unit 130 includes a data sorting unit 132, a position determination unit 134, an inverse gamma correction unit 136, a weight calculation unit 138, a gamma correction unit 140, and a data alignment unit 142.

The data sorting unit 132 sorts red, green, and blue input data Rin, Gin, and Bin of one frame, input from a main body or a graphics card of an external system, by color, supplies the sorted green input data Gin to the data alignment unit 142, and supplies the red and blue input data Rin and Bin to the position determination unit 134.

The position determination unit 134 determines whether the red input data Rin are data that are input to a first pixel row PH1 of the display panel, and the blue input data Bin are data that are input to an n-th (last) pixel column PVn of the display panel.

Determining that the red input data Rin are data that are input to the first pixel row PH1 of the display panel, the position determination unit 134 supplies the red input data Rin to the data alignment unit 142. Determining that the red input data Rin are not data that are input to the first pixel row PH1 of the display panel (i.e. the red input data Rin are data that are input to any one of the second to m-th pixel rows PH2 to PHm), the position determination unit 134 supplies the red input data Rin to the inverse gamma correction unit 136.

Determining that the blue input data Bin are data that are input to the n-th pixel column PVn of the display panel, the position determination unit 134 supplies the blue input data Bin to the data alignment unit 142. Determining that the blue input data Bin are not data that are input to the n-th pixel column PVn of the display panel, the position determination unit 134 supplies the blue input data Bin to the inverse gamma correction unit 136.

The inverse gamma correction unit 136 inversely gamma-corrects the red and blue input data Rin and Bin from the position determination unit 134 such that a luminance value of each of the red and blue input data Rin and Bin based on a contrast value thereof is linearly changed. Subsequently, red and blue input data Rdg and Bdg, which have been inversely gamma-corrected such that gamma correction applied to the red and blue input data Rin and Bin is removed, are linearized, and are then supplied to the weight calculation unit 138.

In order to reduce the difference in contrast between red (R) sub-pixels of two unit pixels that are vertically adjacent to each other, the weight calculation unit 138 adds predetermined weights $\alpha$ and $\beta$ to red data Rdg of the red (R) sub-pixels located above and below a green (G) sub-pixel. That is, the weight calculation unit 138 adds a first weight $\alpha$ to red data R(i,j) of the red sub-pixel of the current pixel row, and adds a second weight $\beta$ to red data R(i−1,j) of the red sub-pixel of the previous pixel row. In order to reduce the difference in contrast between blue (B) sub-pixels of two unit pixels that are horizontally adjacent to each other, the weight calculation unit 138 adds predetermined weights $\alpha$ and $\beta$ to blue data Bdg of the blue (B) sub-pixels located left and right of a green (G) sub-pixel. That is, the weight calculation unit 138 adds a first weight $\alpha$ to red data B(i,j) of the blue sub-pixel of the current pixel column, and adds a second weight $\beta$ to blue data R(i,j+1) of the blue sub-pixel of the next pixel column. Therefore, it is possible to reduce the difference in contrast between neighboring unit pixels, thereby improving image quality without reducing sharpness.

The gamma correction unit 140 gamma-corrects red and blue data Rw and Bw, to which the weights have been added by the weight calculation unit 138, to non-linearize the red and blue data Rw and Bw, and supplies modulated red and blue data Rgam and Bgam to the data alignment unit 142.

The data alignment unit 142 aligns the red and blue data Rgam and Bgam from the gamma correction unit 140 and the green input data Gin from the data sorting unit 132 such that the red and blue data Rgam and Bgam and the green input data Gin are suitable for the unit pixel arrangement structure of the display panel, and outputs modulated red, green, and blue data R', G', and B'.

Figure 6:
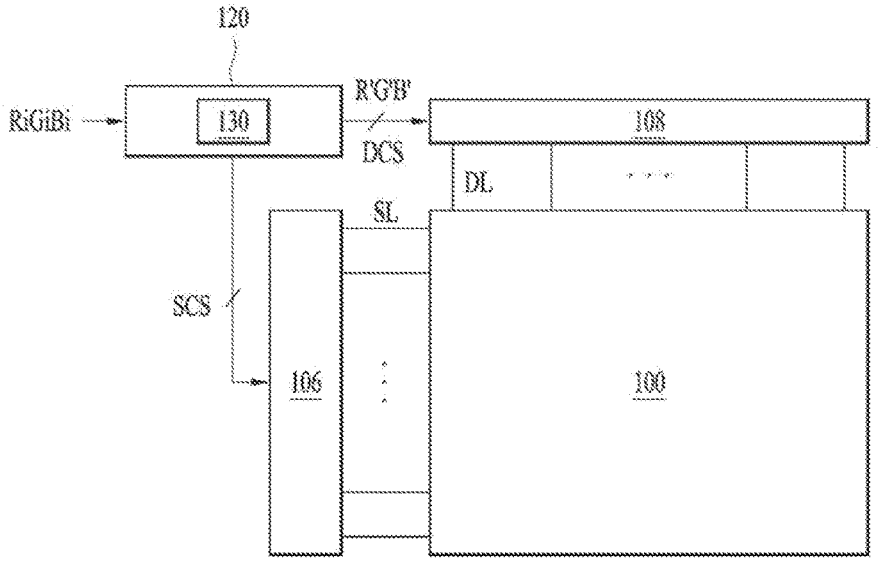
FIG. 6 is a block diagram showing a display device having the image processing unit shown in FIG. 5.

FIG. 6 is a block diagram showing a display device having the image processing unit shown in FIG. 5.

As shown in FIG. 6, the display device includes a display panel 100, a panel driving unit including a data driver 108 and a scan driver 106 for driving the display panel 100, and a timing controller 120 for controlling the panel driving unit.

The data driver 108 converts digital data from the timing controller 120 into analog data voltage in response to a data control signal DCS from the timing controller 120, and supplies the analog data voltage to a data line DL when each scan line SL is driven.

The scan driver 106 sequentially drives the scan lines SL of the display panel 100 in response to a scan control signal from the timing controller 120. The scan driver 106 supplies a high scan pulse for a scanning period of each scan line SL, and supplies a low scan pulse for the rest period during which each scan line SL is driven.

The timing controller 120 generates a plurality of synchronization signals, such as a vertical synchronization signal Vsync, a horizontal synchronization signal Hsync, a data enable signal, a data control signal DCS for controlling driving timing of the data driver 108 using a dot clock, and a scan control signal SCS for controlling driving timing of the scan driver 106, which are input from a host computer (not shown). The timing controller 120 outputs the generated data control signal DCS and scan control signal SCS to the data driver 108 and the scan driver 106, respectively. The data control signal DCS includes a source start pulse and a source sampling clock for controlling the latch of a data signal, a polarity control signal for controlling the polarity of the data signal, and a source output enable signal for controlling an output period of the data signal. The scan control signal SCS includes a scan start pulse and a scan shift clock for controlling scanning of a scan signal, and a scan output enable signal for controlling an output period of the scan signal.

The timing controller 120 signal-processes image data input from the host system, and supplies the signal-processed image data to the data driver 108. The image processing unit 130, which is mounted in the timing controller 120, performs image processing such that red (R) sub-pixels adjacent upward and downward to the green (G) sub-pixel in each unit pixel are driven in cooperation with each other, and blue (B) sub-pixels adjacent left and right of the green (G) sub-pixel in each unit pixel are driven in cooperation with each other as previously described. Therefore, horizontal color symmetry and vertical color symmetry are achieved for a bright (or dark) image displayed on a dark (or bright) background image, thereby alleviating a color shift phenomenon.

Although the image processing unit 130 is shown as being mounted in the timing controller 120 by way of example, the image processing unit 130 may be disposed between the timing controller 120 and the data driver 108, or may be disposed at an input end of the timing controller 120.

Figure 7A:
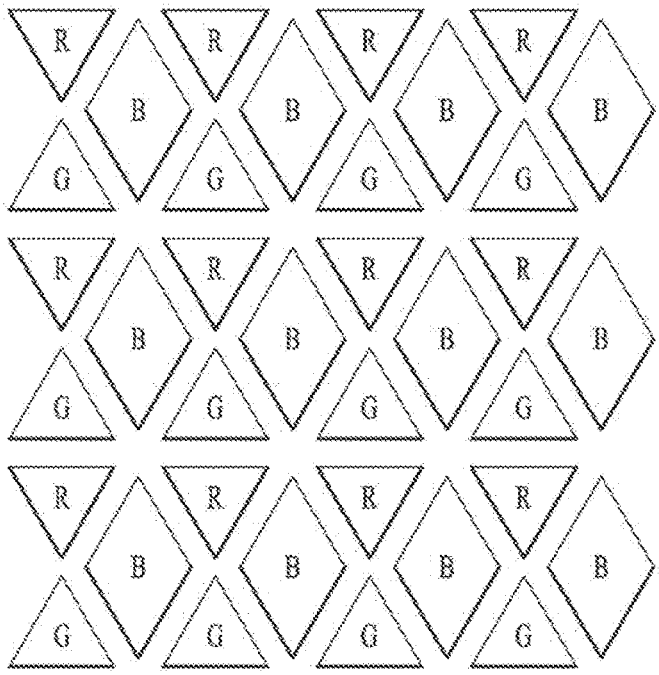
FIGS. 7A and 7B are views illustrating embodiments that are different from the unit pixel structure shown in FIG. 1.
Figure 7B:
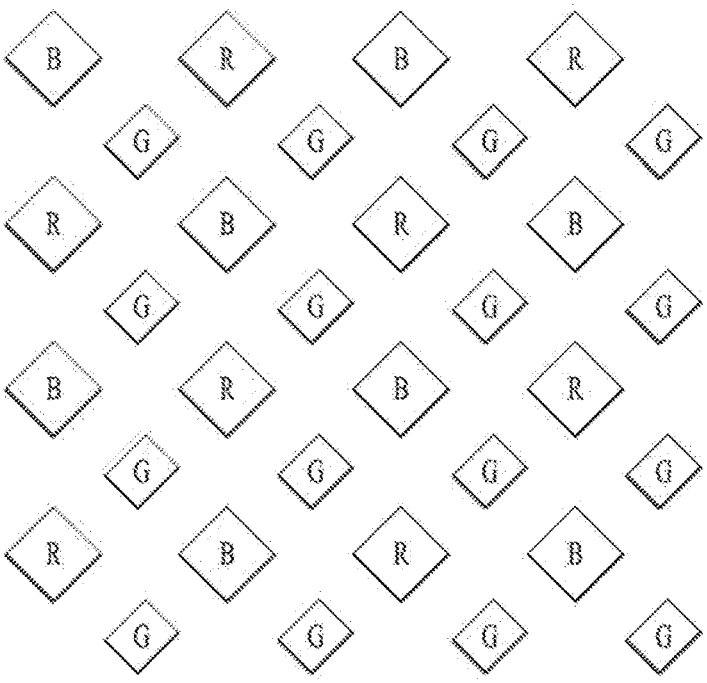

Meanwhile, although the unit pixel structure shown in FIG. 1 was described by way of example, the present invention may be applied to structures shown in FIGS. 7A and 7B.

Each unit pixel shown in FIG. 7A includes triangular red (R) and green (G) sub-pixels, and a diamond-shaped blue (B) sub-pixel. The red (R) and green (G) sub-pixels are arranged in different horizontal lines so as to be alternately arranged in the same vertical line, and the blue (B) sub-pixel is arranged in a different vertical line than the red (R) and green (G) sub-pixels. In the unit pixels shown in FIG. 7A, input data of the red (R) and blue (B) sub-pixels are modulated through Equations 1 and 2 such that upper, lower, left, and right data are driven in cooperation with each other, thereby alleviating a color shift phenomenon.

Each unit pixel shown in FIG. 7B includes red (R) and blue (B) sub-pixels arranged in the same horizontal line, and a green (G) sub-pixel is arranged in a different horizontal line than the red (R) and blue (B) sub-pixels. The red (R) and blue (B) sub-pixels are alternately arranged in the same vertical line. In each unit pixel shown in FIG. 7B, the red (R) and blue (B) sub-pixels are arranged in the same horizontal line. Consequently, input data of the red (R) and blue (B) sub-pixels are modulated through Equation 1 such that upper, lower, left, and right data are driven in cooperation with each other, thereby alleviating a color shift phenomenon.

Horizontal color symmetry and vertical color symmetry are achieved for a bright (or dark) image displayed on a dark (or bright) background image, thereby alleviating a color shift phenomenon without reducing sharpness. In addition, the luminance of the sub-pixels disposed at the outermost edge of the bright (or dark) image is lowered, thereby further alleviating a color shift phenomenon.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A display device comprising:

a display panel having a plurality of unit pixels, each unit pixel of the plurality of unit pixels comprising first and second sub-pixels alternately arranged in a same first vertical line and a third sub-pixel arranged in a second vertical line different than the first vertical line where the first and second sub-pixels are arranged; and an image processing unit for converting data such that first sub-pixels adjacent upward and downward to the second sub-pixel in each unit pixel are driven in cooperation with each other, and third sub-pixels adjacent left and right of the second sub-pixel in each unit pixel are driven in cooperation with each other, when an image is realized on a background image of the display panel while having a different brightness than the background image, the third sub-pixels are driven in cooperation with each other at leftmost and rightmost portions of the image having the different brightness than the background image to realize a color of the third sub-pixel.

2. The display device according to claim 1, wherein the first sub-pixel is a blue sub-pixel, the second sub-pixel is a red sub-pixel, and the third sub-pixel is a green sub-pixel.

3. The display device according to claim 1, wherein the first sub-pixel is a red sub-pixel, the second sub-pixel is a green sub-pixel, and the third sub-pixel is a blue sub-pixel, the blue sub-pixel having a larger area than the red and green sub-pixels.

4. The display device according to claim 3, wherein the image processing unit comprises:

a data sorting unit for sorting red input data of the red sub-pixel, green input data of the green sub-pixel, and blue input data of the blue sub-pixel by color;

an inverse gamma correction unit for inversely gamma-correcting the sorted red and blue input data;

a weight calculation unit for adding weights to the inversely gamma-corrected red and blue data;

a gamma correction unit for gamma-correcting the red and blue data having the weights added thereto; and a data alignment unit for aligning the gamma-corrected red and blue data and the green input data sorted by the data sorting unit and outputting modulated red, green, and blue data.

5. The display device according to claim 4, wherein the image processing unit further comprises:

a position determination unit for determining whether the sorted red input data are data that are input to a first pixel row of the display panel and determining whether the sorted blue input data are data that are input to a last pixel column of the display panel, and wherein:

the data alignment unit outputs the input data without change responsive to determining that the red input data are input to the first pixel row of the display panel, and outputs the input data without change responsive to determining that the blue input data are input to the last pixel column of the display panel.

6. The display device according to claim 4, wherein the weight calculation unit adds predetermined weights to red data of red sub-pixels located above and below the green sub-pixel, and adds predetermined weights to blue data of blue (B) sub-pixels located left and right of the green sub-pixel.

7. The display device according to claim 1, wherein the first sub-pixels are driven in cooperation with each other at uppermost and lowermost portions of the image having the different brightness than the background image to realize a color of the first sub-pixels.

8. A display panel having a plurality of unit pixels, wherein:

each of the unit pixels comprises:

first and second sub-pixels alternately arranged in a same first vertical line; and a third sub-pixel arranged in a second vertical line different than the first vertical line, and when an image is realized on a background image of the display panel while having a different brightness than the background image, the third sub-pixels are driven in cooperation with each other at leftmost and rightmost portions of the image having the different brightness than the background image to realize a color of the third sub-pixel.

9. The display panel according to claim 8, wherein:

the first sub-pixels are disposed above and below the second sub-pixel, the third sub-pixels are disposed left and right of the second sub-pixel, and the first sub-pixels are driven in cooperation with each other at uppermost and lowermost portions of the image having the different brightness than the background image to realize a color of the first sub-pixels.

* * * * *